US005214349A

United States Patent [19]

Sakata et al.

[11] Patent Number: 5,214,349

[45] Date of Patent: May 25, 1993

[54] COLOR CATHODE RAY TUBE AND COLOR SELECTION ELECTRODE DEVICE OF COLOR CATHODE RAY TUBE

[75] Inventors: Shigeki Sakata; Akito Yamamoto; Mizuki Murata, all of Nagaokakyo, Japan

[73] Assignee: Mitsubishi Denki Kabushiki Kaisha, Tokyo, Japan

[21] Appl. No.: 781,910

[22] Filed: Oct. 24, 1991

[30] Foreign Application Priority Data

| | | | |
|---|---|---|---|
| Oct. 26, 1990 | [JP] | Japan | 2-288881 |
| Oct. 29, 1990 | [JP] | Japan | 2-294084 |
| Oct. 29, 1990 | [JP] | Japan | 2-294085 |
| Jan. 24, 1991 | [JP] | Japan | 3-41433 |
| Mar. 6, 1991 | [JP] | Japan | 3-68986 |
| May 15, 1991 | [JP] | Japan | 3-110589 |

[51] Int. Cl.[5] ..... H01J 29/07

[52] U.S. Cl. ..... 313/407; 313/348; 313/403

[58] Field of Search ..... 313/407, 403, 402, 348

[56] References Cited

U.S. PATENT DOCUMENTS

| | | | |
|---|---|---|---|
| 2,397,233 | 3/1946 | Bingley | 313/348 |
| 4,333,034 | 6/1982 | Ohgoshi et al. | 313/407 |

FOREIGN PATENT DOCUMENTS

| | | |
|---|---|---|
| 60-6066 | 2/1985 | Japan . |
| 61-31583 | 7/1986 | Japan . |

*Primary Examiner*—Palmer C. DeMeo

[57] ABSTRACT

A color selection electrode device mounts: a color selection electrode composed of filaments for regulating the position which an electron beam of the cathode ray tube reaches on a pair of U-shaped frame bodies between which the color selection electrode is stretched. Support pieces are provided for connecting both end portions of the pair of frame bodies and holding the frame bodies at a predetermined space. The color selection electrode is a metal electrode which is composed of, for example, a multiplicity of filaments. The support pieces are composed of an elastic material and are bent due to the load which is applied to the frame bodies, thereby shortening the distance between the frame bodies. In this state, the color selection electrode is stretched between the frame bodies and both ends thereof are welded to the frame bodies. Thereafter, when the load is removed, a predetermined tension is uniformly applied to the color selection electrode by the elastic restoring force. The pair of frame bodes may have either a large rigidity or an appropriate elasticity.

15 Claims, 18 Drawing Sheets

FIG. 30 *PRIOR ART*
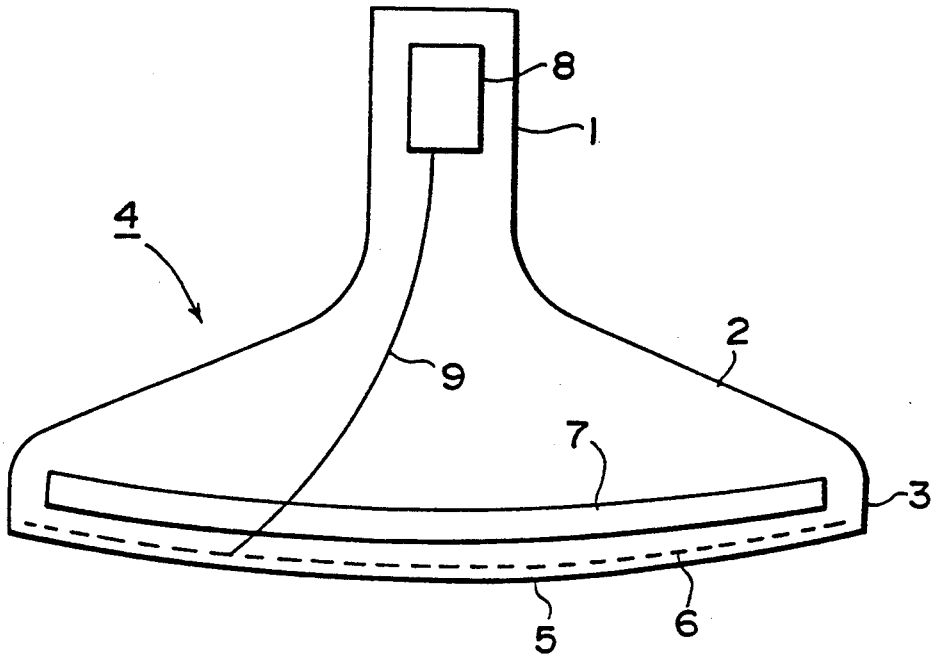
FIG. 31 *PRIOR ART*
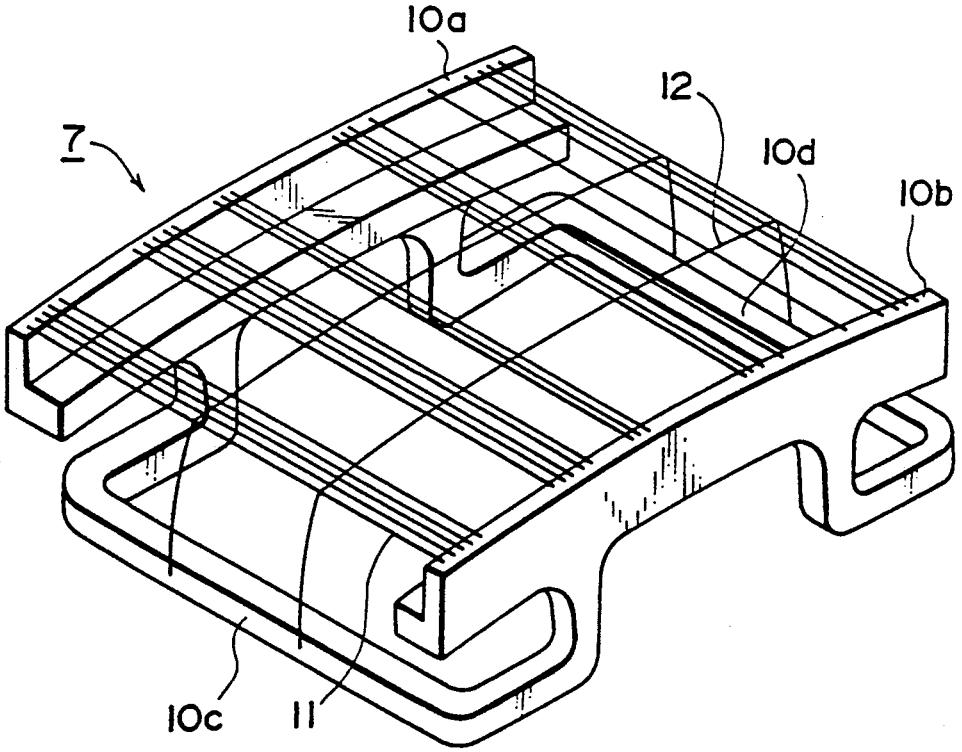

FIG. 34 *PRIOR ART*
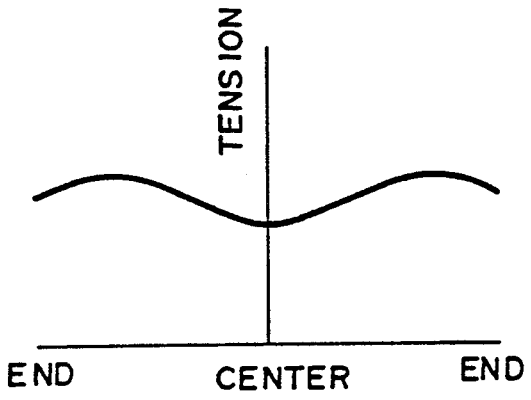

COLOR CATHODE RAY TUBE AND COLOR SELECTION ELECTRODE DEVICE OF COLOR CATHODE RAY TUBE

BACKGROUND OF THE INVENTION

1. Field of the Invention

The present invention relates to a color cathode ray tube and a color selection electrode device of a color cathode ray tube for restricting the position which an electron beam reaches.

2. Description of the Prior Art

In a general color cathode ray tube, a panel portion (panel glass) 3 is welded through frit to the open end of a funnel portion 2 having a neck portion 1 so as to constitute a vessel 4, as shown in FIG. 30. A phosphor screen 6 is formed on the inner surface of a face plate 5 of the panel portion 3, and a color selection electrode device 7 is disposed opposite to the phosphor screen 6. Electron beams respectively corresponding to red, green and blue, for example, are landed on the corresponding phosphors after they are regulated by a color selection electrode device 7.

FIG. 31 is a perspective view of a conventional color selection electrode device of a cathode ray tube. In FIG. 31 an opposing pair of longitudinal frame members 10*a* and 10*b* are provided and the gaps therebetween are bridged by left and right arm portions 10*c* and 10*d*. A multiplicity of filaments which constitute a color selection electrode 11 are stretched between the top end surfaces of the opposing longitudinal frame members 10*a*, 10*b*. Several damper wires 12 are provided between the left and right arms 10*c* and 10*d* as a damping material in such a manner that the damper wires 12 intersect the filaments 11.

The color selection electrode device 7 is attached to the inside of the panel portion 3 by three- or four-point holding.

In manufacturing the conventional color selection electrode device 7, the pair of arm portions 10*c*, 10*d* composed of an elastic material are first welded to the opposing pair of frame members 10*a*, 10*b* at the vessel points or in the vicinity thereof. A load is applied to the welding points of the opposing pair of longitudinal frame members or at predetermined points in the vicinity thereof by two-point support so as to shorten the distance between the supporting points by bending the pair of arms 10*c*, 10*d* by a predetermined amount within their elastic regions, as shown in FIG. 32. In FIG. 33, the broken lines and the solid lines respectively show the longitudinal frame members 10*a*, 10*b* and the arm portions 10*c*, 10*d* before and after the load is applied. As shown in FIG. 33, when a load is applied to the longitudinal frame members 10*a*, 10*b* in the vicinity of both ends, namely, at the vessel points or two points in the vicinity thereof, each of the longitudinal frame members is bent and the distance therebetween is shortened. In this state, a color selection electrode 11 which is composed of a multiplicity of metal filaments are stretched between the longitudinal frame members 10*a*, 10*b* and welded thereto, as shown in FIG. 32. Thereafter, when the load between the supporting points of the longitudinal frame members 10*a*, 10*b* is removed, the shortened distance between the longitudinal frame members 10*a*, 10*b* is restored to the original distance by the restoring force of the arm portions 10*c*, 10*d* each of which is made of an elastic material, and a tension is applied to the stretched color selection electrode 11.

Several damper wires 12 are provided between the arm portions 10*c*, 10*d* by spot welding in such a manner that the damper wires 12 intersect the color selection electrode 11, as shown in FIG. 31, thereby completing the color selection electrode device 7.

In a conventional color selection electrode device having the above-described structure, since it is important to apply a predetermined tension to the filaments, which constitutes the color selection electrode, in order to prevent the screen from vibrating due to the resonance of the filaments with an external vibration, the frame is disadvantageously required to have a complicated structure, a large size and a great weight. In addition, since the points of each longitudinal frame member at which the load is applied are two points in the vicinity of both ends thereof, it is difficult to obtain a predetermined tension which is uniform at any point in a plane, as shown in the tension distribution in FIG. 34. It is therefore necessary to provide damper wires as a damping material for filaments as the color selection electrode have an insufficient tension, and the shadows of the wires are disadvantageously projected onto the screen, thereby making it difficult to obtain a high-definition picture.

SUMMARY OF THE INVENTION

Accordingly, it is an object of the present invention to eliminate the above-described problems in the related art and to provide a color selection electrode device of a cathode ray tube which is capable of applying a uniform tension to a color selection electrode and suppressing the time constant of damping to a low value with a simple and light-weight frame structure and without lowering the frame rigidity.

To achieve this aim, a color selection electrode device according to the present invention comprises: a color selection electrode composed of filaments for regulating the position which an electron beam of a cathode ray tube reaches; a pair of U-shaped frame bodies between which the color selection electrode is stretched; support pieces for connecting both ends of the frame bodies and holding the frame bodies at a predetermined space, the support pieces having an elastic restoring force which applies a predetermined tension to the color selection electrode stretched between the pair of frame bodies. The color selection electrode is a metal electrode which is composed of, for example, a multiplicity of filaments. The pair of frame bodies may have either a large rigidity or an appropriate elasticity. The support pieces are bent due to the load which is applied to the pair of frame bodies and are restored when the load is removed. In this way, a necessary tension is uniformly applied to the color selection electrode.

The above and other objects, features and advantages of the present invention will become clear from the following description of the preferred embodiments thereof, taken in conjunction with the accompanying drawings.

BRIEF DESCRIPTION OF THE DRAWINGS

FIG. 30 is an explanatory view of a vessel which constitutes a cathode ray tube;

FIG. 31 is a perspective view of a conventional color selection electrode device of a cathode ray tube;

FIG. 34 shows the tension distribution of the color selection electrode (filaments) stretched between the longitudinal frame members of the conventional color selection electrode device shown in FIG. 31.

DESCRIPTION OF THE PREFERRED EMBODIMENTS

Preferred embodiments of the present invention will be explained hereinunder with reference to the accompanying drawings.

Figure 1:
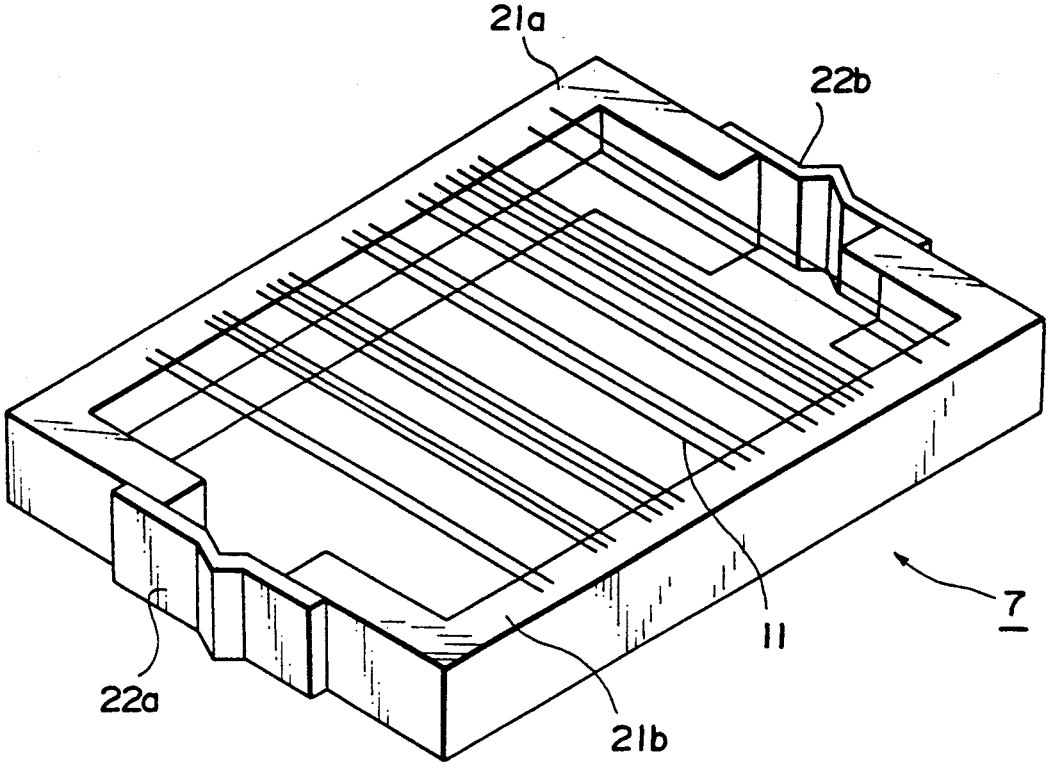
FIG. 1 is a perspective view of the external appearance of a first embodiment of a color selection electrode device of a cathode ray tube according to the present invention.

FIG. 1 is a perspective view of a first embodiment of a color selection electrode device of a cathode ray tube. The same numerals are provided for the elements which are the same as those shown in FIG. 31. An opposing pair of frame bodies 21*a*, 21*b* having a substantially U-shaped cross section are composed of an anticorrosive material such as stainless steel. The gaps between the frame bodies 21*a*, 21*b* are bridged over by support pieces 22*a*, 22*b* which are composed of an anticorrosive spring material such as stainless steel SUS631. On the surfaces of the opposing frame bodies 21*a*, 21*b* facing the face plate of a cathode ray tube, a multiplicity of metal filaments, for example, are stretched as a color selection electrode 11.

Figure 2:
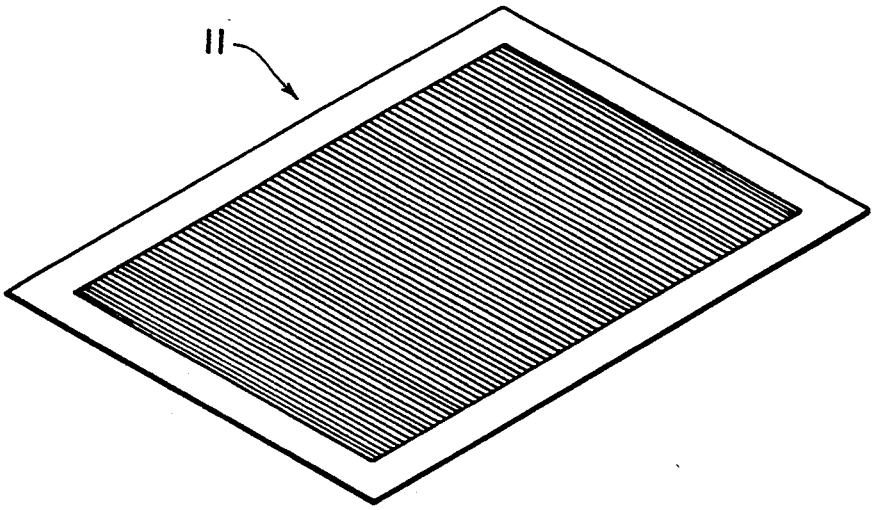
FIG. 2 is a perspective view of an example of a color selection electrode of the first embodiment.
Figure 3:
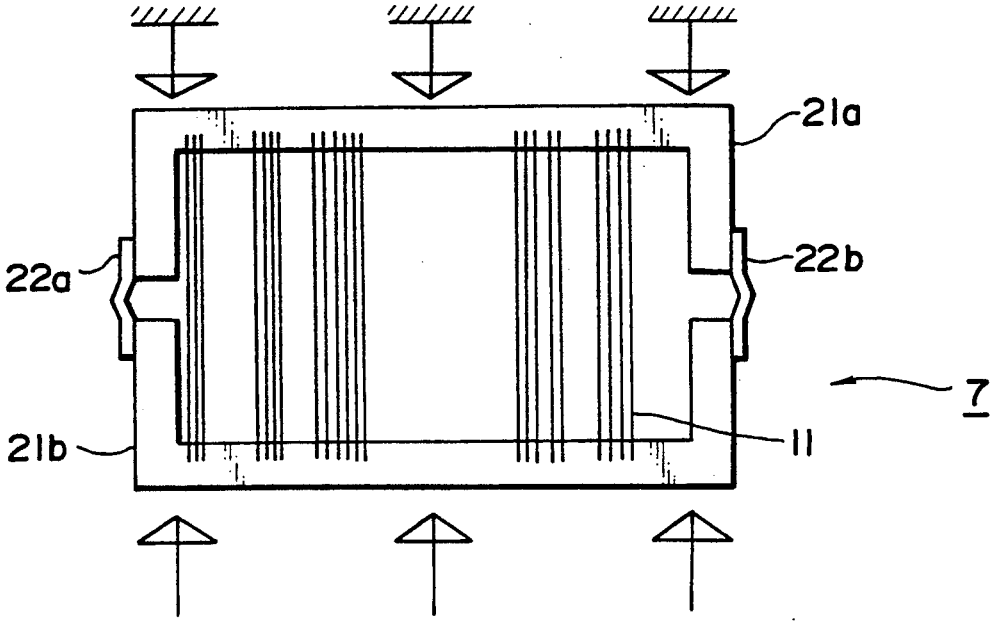
FIG. 3 is a plan view of the first embodiment, explaining the method of applying a load to the frame bodies thereof.

FIG. 2 shows the color selection electrode 11. A material which is unlikely to get rusted, for example, a thin stainless steel sheet is etched so as to form a multiplicity of filaments. The longer sides of the peripheral portions of the color selection electrode 11 are welded to the frame bodies 21*a* and 21*b*, and the remaining peripheral portions are cut away as unnecessary.

In this embodiment, a material which is unlikely to get rusted, for example, stainless steel is used for the color selection electrode, and an anticorrosive material such as stainless steel is used for the frame bodies and the support pieces. It is therefore possible to obviate a blackening heat-treatment process for preventing the color selection electrode device from rusting. As a result, it is possible to suppress the lowering of the tension of the color selection electrode caused by the blackening heat-treatment process, thereby improving the resistance to vibration and realizing a high-definition picture. In addition, it is possible to reduce the manufacturing cost and shorten the manufacturing time.

A method of manufacturing the color selection electrode device of the first embodiment will now be explained.

In this embodiment, a load is applied to the opposing pair of frame bodies 21*a*, 21*b* so that the support pieces 22*a*, 22*b* composed of the spring material are bent by a predetermined amount within their elastic regions and the distance between the frame bodies 21*a*, 21*b* is shortened. In this state, a multiplicity of filaments are stretched between the frame bodies 21*a*, 21*b* as the color selection electrode 11 and welded thereto. Thereafter, when the load applied to the frame bodies 21*a*, 21*b* is removed, the shortened distance between the frame bodies 21*a*, 21*b* is extended and restored to the original distance by the restoring force of the support pieces 22*a*, 22*b*. The filaments which are stretched between and welded to the frame bodies 21*a*, 21*b* have a predetermined uniform tension and the color selection electrode 11 has a uniform tension distribution.

In this color selection electrode, at the time of operation, namely, when an electron beam is projected onto the color selection electrode and the phosphor screen, the metal filaments 11 are heated to about 100° C. by the radiation of the electron beam and each of the metal filaments 11 thermally expands. The elongation of the filaments due to the thermal expansion, however, is cancelled by the restoring force of the displaced support pieces 22*a*, 22, and a tension which is approximately equal to the initial tension is applied to each of the metal filaments 11.

In this way, according to this embodiment, since the filaments are stretched and tightened by using the restoring force of the support pieces 22*a*, 22*b*, it is possible to obtain a predetermined uniform tension, to prevent the resonance of the filaments 11 with an external vibration and to dispense with the need for stretching a damper wire.

Figure 4:
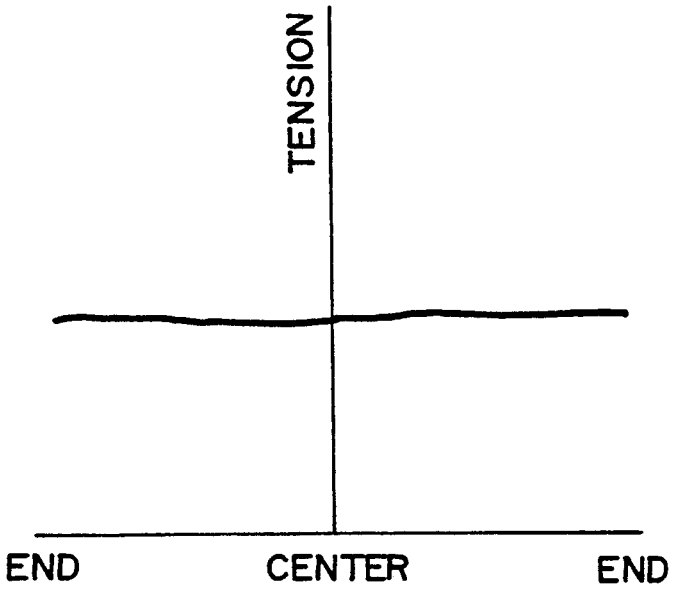
FIG. 4 shows the tension distribution of the color selection electrode of the first embodiment.
Figure 8:
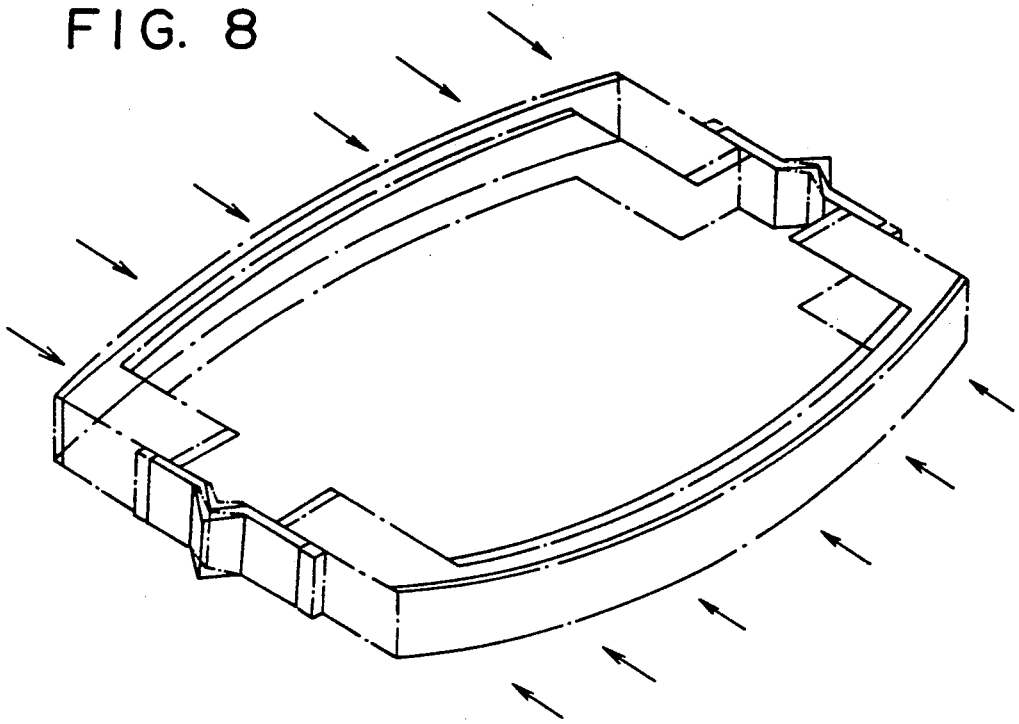
FIG. 8 is a perspective view of the modification shown in FIG. 7, showing the frame bodies composed of an elastic material before and after deformation.
Figure 9:
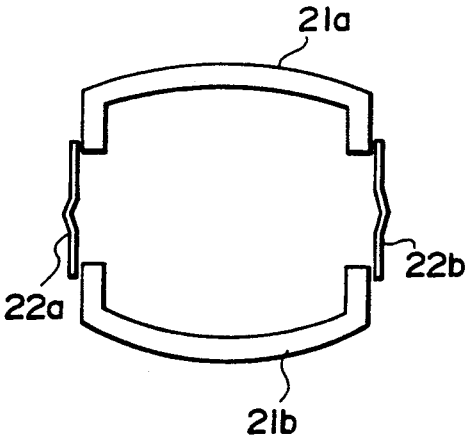
FIG. 9 is a plan view of the frame bodies of the modification shown in FIG. 7 before deformation.
Figure 10:
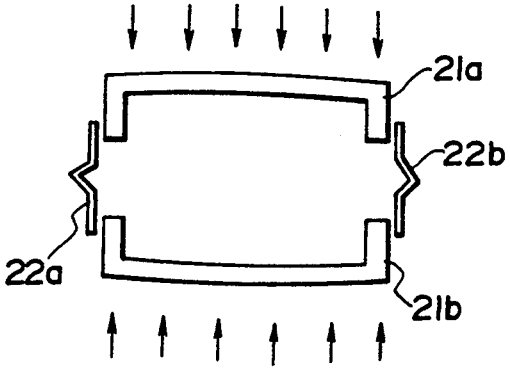
FIG. 10 is a plan view of the frame bodies of the modification shown in FIG. 7 after deformation.

A load is efficiently applied to the frame bodes 21*a*, 21*b* in the following manner. A distributed load is applied to the frame bodies 21*a*, 21*b* at not less than three points so that the displacement amount of the distance between the opposing pair of frame bodies 21*a*, 21*b* at the central portion is larger than that of the distance between the frame bodies 21*a*, 21*b* at either end portion, as shown in FIGS. 8 to 10. The support pieces 22*a*, 22*b* composed of the spring material are bent by a predetermined amount within their elastic regions so as to shorten the distance between the frame bodies 21*a*, 21*b*. In this state, the multiplicity of filaments 11 are stretched between and welded to the frame bodies 21*a*, 21*b*. Thereafter, when the load applied to the frame bodies 21*a*, 21*b* is removed, the shortened distance between the frame bodies 21*a*, 21*b* is extended and restored to the original distance by the restoring force of the support pieces 22*a*, 22*b*. The filaments 11 which are stretched between and welded to the frame bodies 21*a*, 21*b* are approximately uniformly stretched at the entire part from both end portions to the central portion, as shown in FIG. 4 at a tension which obviates the stretching of a damper wire for preventing vibration.

According to this load applying method, since the filaments 11 are stretched and tightened by using the restoring force of the support pieces 22*a*, 22*b* and a distributed load is externally applied at not less than three points so that the displacement amount of the distance between the opposing pair of frame bodies 21*a*, 21*b* at the central portion is larger than that of the distance between the frame bodies 21*a*, 21*b* at either end portion, it is possible to make the tension distribution at the central portion and both end portions of the frame bodies 21*a*, 21*b* more uniform, which contributes the prevention of the resonance of the filaments 11 with an external vibration, thereby producing a high-definition picture.

In this embodiment, since the frame bodies 21*a*, 21*b* have a U-shaped cross section, which increases the rigidity of the color selection electrode device, it is possible to reduce the color selection electrode device in size and weight.

Figure 5:
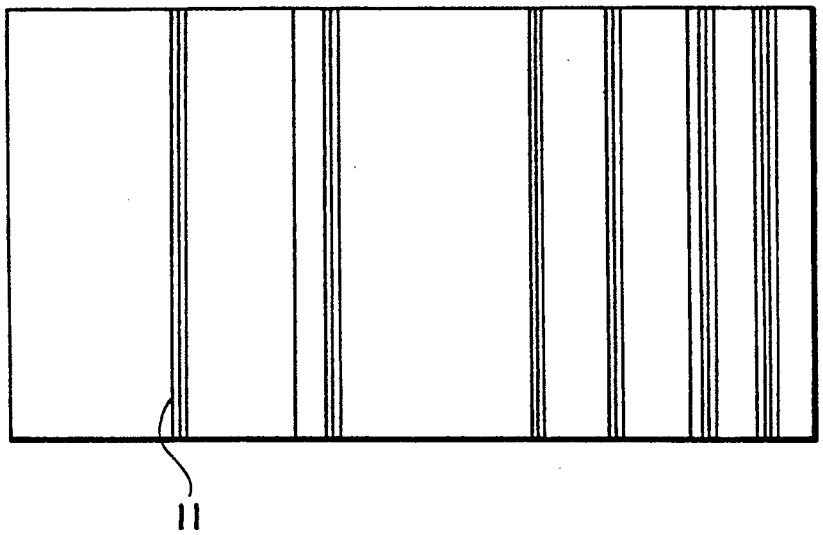
FIG. 5 is a plan view of the example of a color selection electrode shown in FIG. 2.
Figure 6:
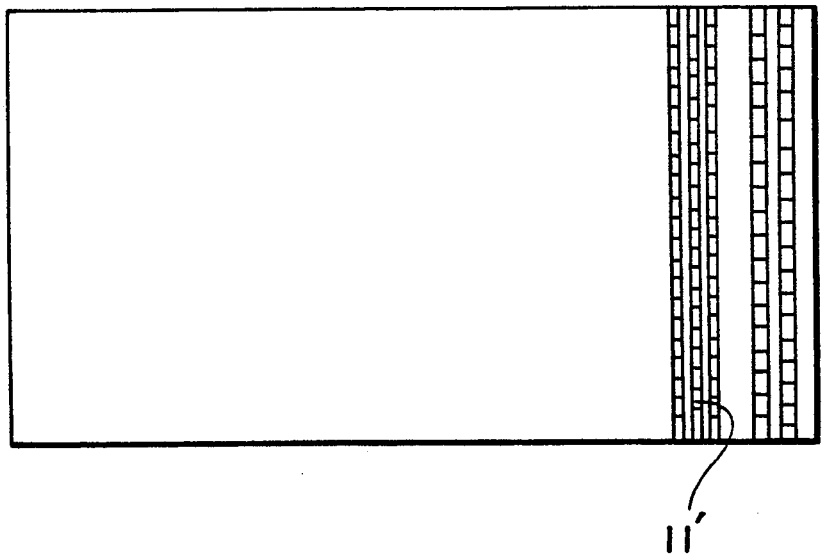
FIG. 6 is a plan view of another example of a color selection electrode of the first embodiment.

Although the multiplicity of filaments are stretched between the opposing pair of frame bodies 21*a*, 21*b* as the color selection electrode 11 in this embodiment, as shown in FIG. 5, a thin sheet 11' provided with a multiplicity of electron beam passing holes may be used, as shown in FIG. 6.

Although a buckling of a leaf spring is used as each of the support pieces 22*a*, 22*d* in this embodiment, the shape of the support piece is not restricted thereto and a coil spring, for example, may be used instead.

Figure 7:
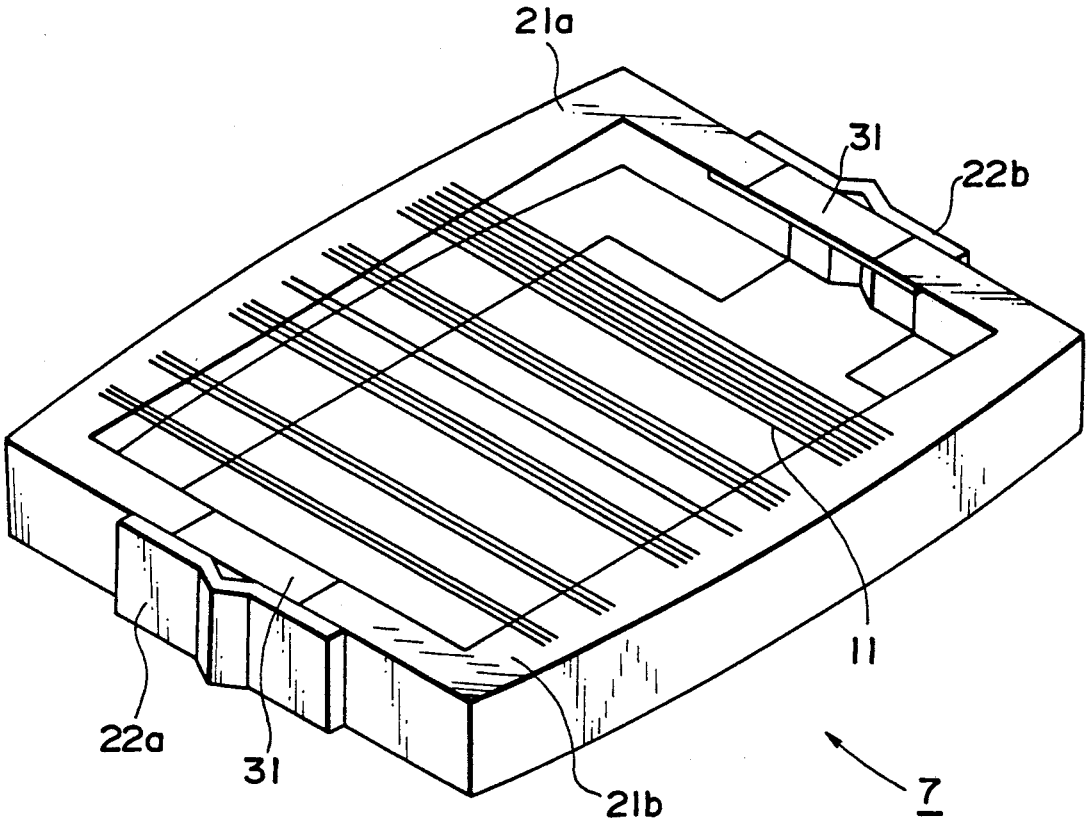
FIG. 7 is a perspective view of the external appearance of a modification of the first embodiment.

In addition, the frame bodies 21*a*, 21*b* may have several modifications, if necessary. For example, they may have a radial configuration at the longer sides so as to increase the rigidity of the longer side to which the filaments 11 are welded, or a metal plate 31 may be welded between the frame bodies 21*a*, 21*b* so as to prevent the frame bodies from warping, as shown in FIG. 7.

As a modification of the first embodiment, the frame bodies 21*a*, 21*b* may be composed of a spring material. In this case, a distributed load is first applied to the frame bodies 21*a*, 21*b* at not less than three points so that the displacement amount of the distance between the opposing pair of frame bodies 21*a*, 21*b*, which correspond to the longer sides of a frame, at the central portion is larger than that of the distance between the frame bodies 21*a*, 21*b* at either end portion, so that the distance between the frame bodies 21*a*, 21*b* is shortened, as shown in FIGS. 8 to 10. FIG. 8 is a perspective view of the frame bodies of the color selection electrode device, FIG. 9 is a plan view thereof before the load is applied, and FIG. 10 is a plan view thereof after the load is applied. In FIG. 8, the broken lines and the solid lines respectively show the frame bodies before and after the load is applied. The longer sides and the shorter sides of the frame each made of the spring material are bent by a predetermined amount within their elastic regions so that the central portions of the longer sides of the frame are bent by an amount larger than the amount by which the central portions of the longitudinal frame members of a conventional color selection electrode devices are bent at two points in the vicinity of both end portions, as shown in FIGS. 8 and 10. At this time, the support pieces 22*a*, 22*b* are also bent by a predetermined amount. In this state, the color selection electrode 11 composed of a multiplicity of filaments is stretched between the opposing frame bodes 21*a*, 21*b* and welded thereto.

Thereafter, when the load applied to the longitudinal sides of the frame bodies 21*a*, 21*b* is removed, the shortened distance between the longer sides of the frame is extended and restored to the original distance by the restoring force of the longer sides and the shorter sides of the frame, which are composed of the spring material. The color selection electrode 11 which is stretched between and welded to the frame bodies 21*a*, 21*b* has a tension of a predetermined distribution.

In order to suppress the resonance of the color selection electrode 11 with an external vibration without stretching a damper wire for preventing vibration, it is necessary to keep the tension above a predetermined value. For this purpose, it is necessary to increase the rigidity of the frame. On the other hand, in order to reduce the weight and size of the frame, it is impossible to increase the rigidity to a great extent. It is therefore best to apply the necessary minimum tension uniformly to the color selection electrode. In this respect, according to this embodiment, a necessary tension having a uniform distribution is obtained, as is obvious from FIG. 4.

As described above, according to this modification, since a spring material is used for the frame of the color selection electrode device, the color selection electrode is welded to the frame while a load is applied to the longer sides of the frame at not less than three points so that the amount of restoration is larger at the central portion, and thereafter the load is removed, a necessary tension having a uniform distribution is applied to the color selection electrode 11 by the restoring force of the frame. It is therefore possible to suppress the resonance of the color selection electrode with an external vibration and, hence to omit a damper wire. It is also possible to reduce the size and the weight of the color selection electrode device.

Figure 11:
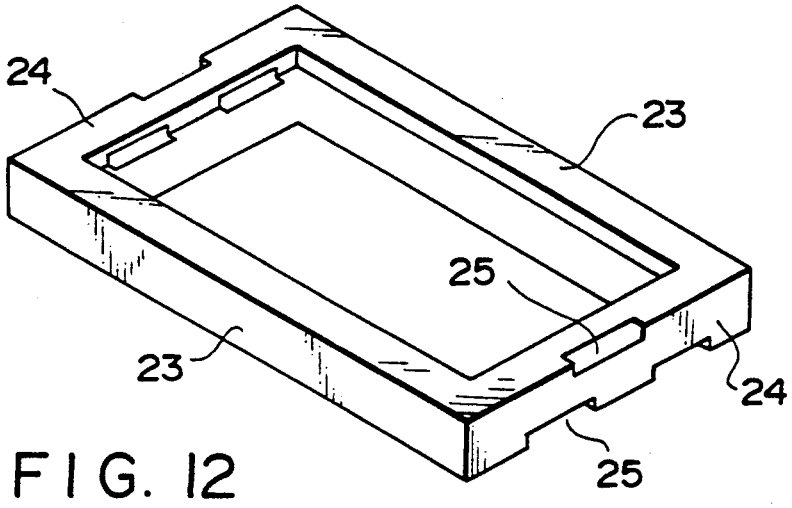
FIG. 11 is a perspective view of the frame body of another modification of the first embodiment, the frame body being composed of an elastic material.
Figure 12:
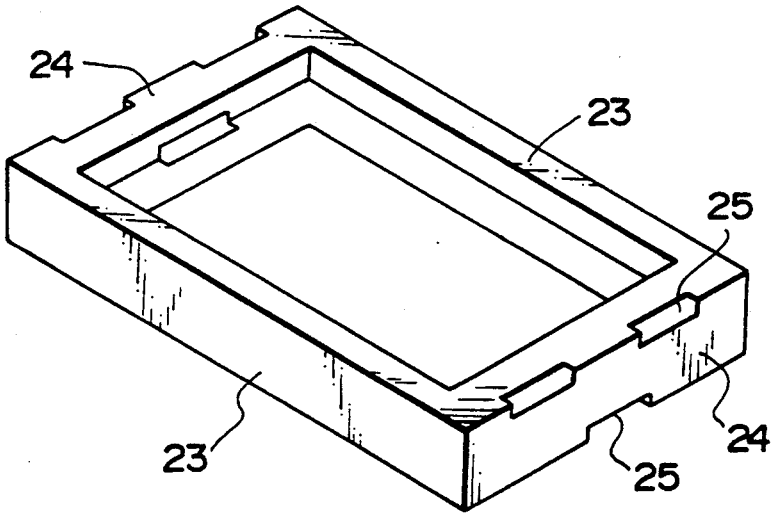
FIG. 12 is a perspective view of the frame body of still another modification of the first embodiment, the frame body being composed of an elastic material.

Although the frame is composed of the frame bodies 21*a*, 21*b* and the support pieces 22*a*, 22*b* for connecting the frame bodies 21*a*, 21*b* in this modification, the frame may have an integral structure, as shown in FIGS. 11 and 12. Various modifications for optimizing the elasticity (restoring force) in accordance with the required pressurizing force are also possible. For example, notches 25 may be formed on the shorter sides 24 so as to adjust the elasticity. Alternatively, spring materials having different elastic coefficients may be used for the longer sides 23 and the shorter sides 24 of the frame so as to optimize the elasticity (restoring force).

The electrode surface of the frame of the color selection electrode device may be a curved surface in conformity with the curved surface of the face plate 5 shown in FIG. 30.

Figure 13:
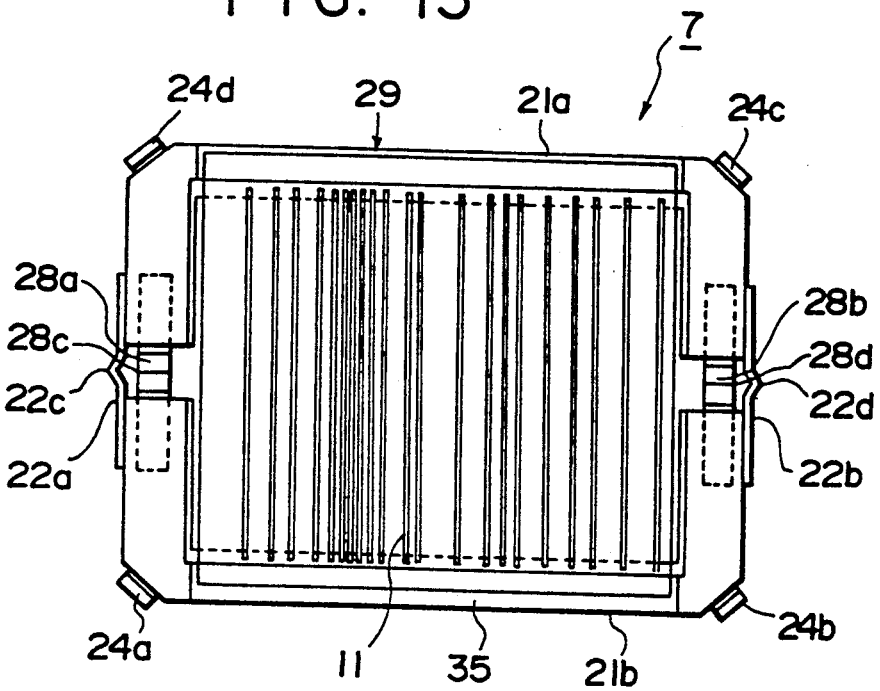
FIG. 13 is a plan view of a second embodiment of a color selection electrode device of a cathode ray tube according to the present invention.
Figure 14:
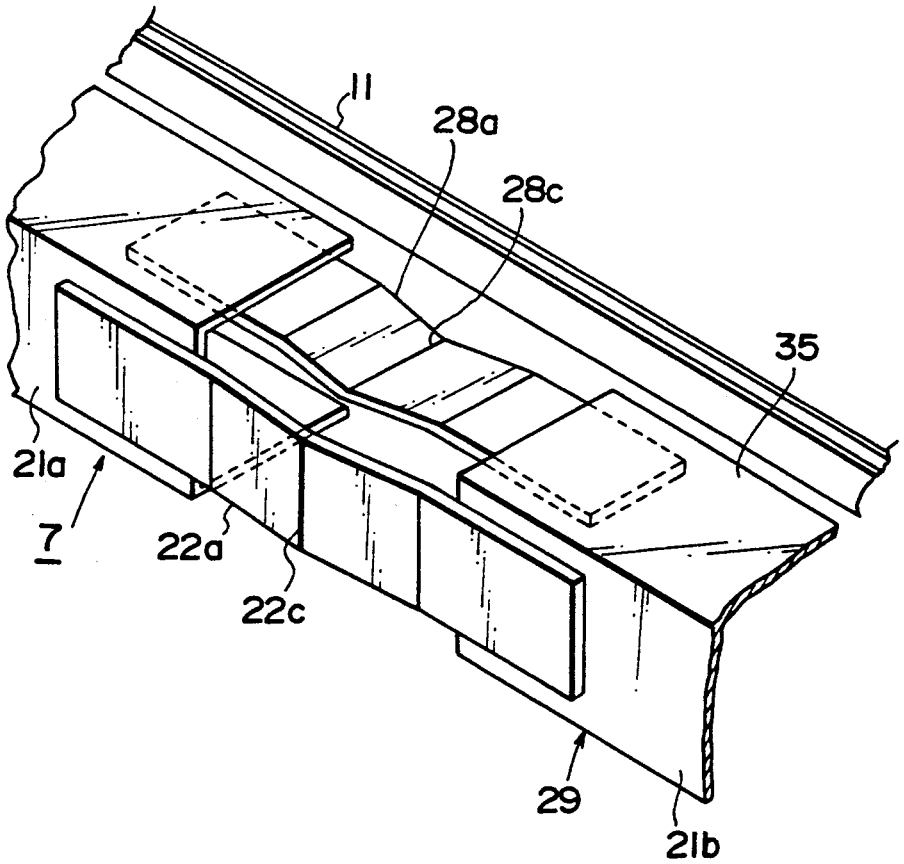
FIG. 14 is a perspective view of the main part of the second embodiment.

FIG. 13 is a plan view of a second embodiment of a color selection electrode device according to the present invention, and FIG. 14 is a perspective view of the main part thereof. In this embodiment, support pieces 28*a*, 28*b* are provided on the short sides of a frame 29 in addition to the support pieces 22*a*, 22*b*.

These support pieces 22*a*, 22*b*, 28*a*, 28*b* each being composed of a long plate are provided with bent portions 22*c*, 22*d*, 28*c* and 28*d* in the widthwise direction of the frame 29. The pair of support pieces 22*a*, 22*b* and the pair of support pieces 28*a*, 28*b* are symmetrically provided on both sides of the frame 29 with both ends being fixed to the frame bodies 21*a*, 21*b*. The support pieces 22*a*, 22*b* are provided on the side surfaces of the frame 29 while the support pieces 28*a*, 28*b* are provided on the inner surfaces of the frame 29, namely, the the frame bodies 21*a*, 21*b* having a U-shaped cross section in parallel with the open surface 35 for receiving the color selection electrode 11.

The support pieces 28*a*, 28*b* which are provided in parallel with the open surface 35 for receiving the color selection electrode 11 are bent along the bent portions 28*c* and 28*d*, respectively, due to their elasticity.

On the other hand, in each of the support pieces 22*a*, 22*b* which are provided on the side surfaces of the frame vertically to the open surface 35, the elastic force at the bent portion 22*c* (22*d*) is set to be smaller on the open surface 35 side and to be larger on the opposite side so that the support piece 22*a* (22*b*) is bent outwardly from the open surface 35 side in a plane containing the support piece 22*a* (22*b*).

Figure 15:
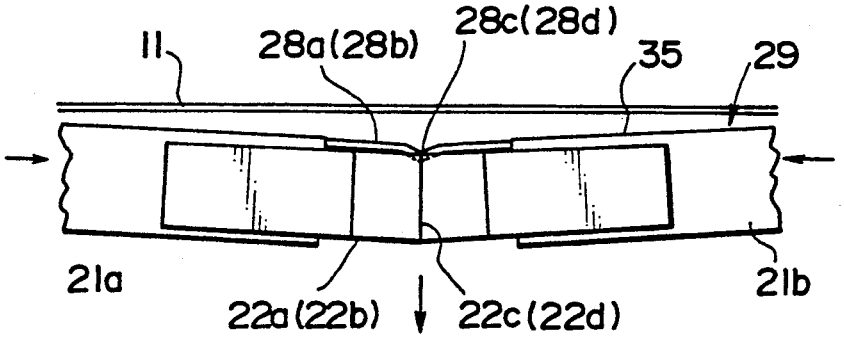
FIG. 15 is a side elevational view of the second embodiment in the state in which a load is applied to the frame bodies.

In this color selection electrode device 7, when the color selection electrode 11 is stretched on the frame 29, if the distance between the opposing longer sides of the frame 29 is shortened by clamping, the support pieces 22*a*, 22*b*, 28*a*, 28*b* are bent in the above-described manner, as shown in the explanatory view in FIG. 15, so that the short sides of the frame 29 are bent outwardly from the open surface 35 for receiving the color selection electrode 11. In other words, the elastic forces of the support pieces 22*a*, 22*b*, 28*a*, 28*b* are set to be appropriate for this action.

Figure 16:
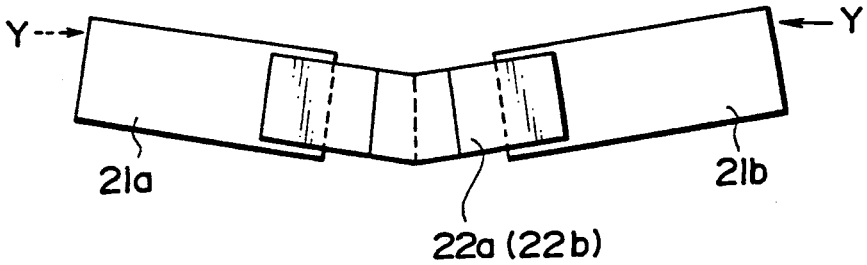
FIG. 16 is a side elevational view of the second embodiment, explaining the method of applying a load to the frame bodies.

If the short sides of the frame 29 are not bent to a desired shape merely by setting the elastic forces of the support pieces 22*a*, 22*b*, 28*a*, 28*b*, the positions at which the load is applied to the longer sides of the frame 29 so as to shorten the distance therebetween are brought closer to the open surface 35 for receiving the color selection electrode 11, as shown in FIG. 16. That is, by applying the load to the longer sides of the frame 29 at the positions indicated by the arrows Y, a desired shape is obtained.

Figure 17:
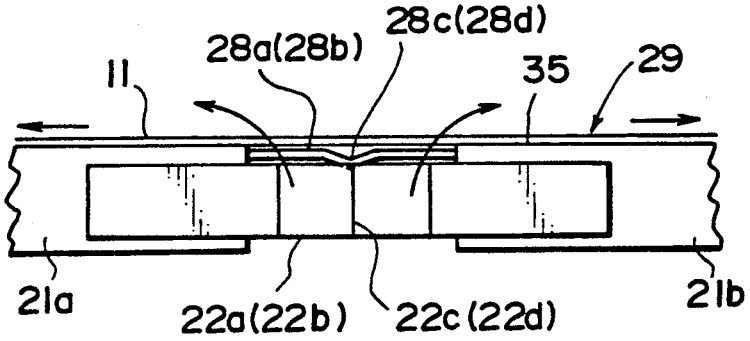
FIG. 17 is a side elevational view of the second embodiment after the load applied to the frame bodies is removed.

In this state, the color selection electrode 11 is stretched and, thereafter, when the frame 29 is released from the clamped state, the bent short sides of the frame 29 are restored to the original positions by the elastic forces of the support pieces 22*a*, 22*b*, 28*a*, 28*b*, as shown in FIG. 17, whereby the color selection electrode 11 is tightened.

As described above, in the color selection electrode device having the above-described structure, since the shorter sides of the frame 29 are constantly bent in a predetermined direction when the distance of the longer sides of the frame 29 is shortened, it is possible to deform the frame 29 in a stable state. It is therefore possible to stabilize the relative position of the frame bodies 21*a*, 21*b* when the color selection electrode 11 is stretched and to uniformly tighten the color selection electrode 11 at the time of release of the load.

In addition, in this embodiment, by providing the support pieces 28*a*, 28*b* in parallel with the open surface 35 for receiving the color selection electrode 11, it is possible to adequately secure the rigidity of the frame 29 in the longitudinal direction, and safely suppress the sideways displacement of the frame bodies 21*a*, 21*b*, thereby making the relative position thereof more stable. In other words, it is possible to prevent the shape of the color selection electrode 11 from changing from a rectangle to a parallelogram.

Figure 18:
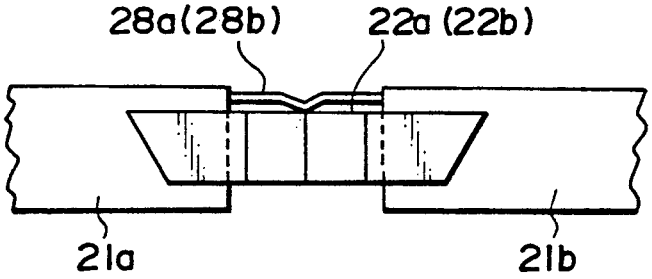
FIG. 18 is a side elevational view of another example of a support piece for connecting the frame bodies of the second embodiment.
Figure 19:
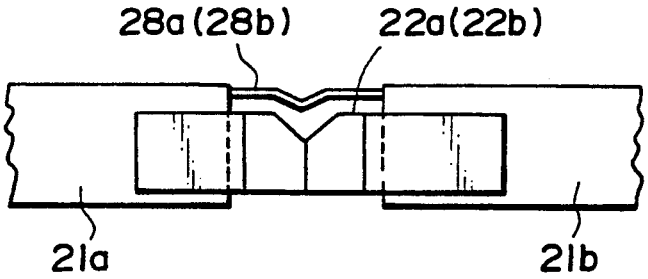
FIG. 19 is a side elevational view of still another example of a support piece for connecting the frame bodies of the second embodiment.

In order to set the elastic force of the support piece 22*a* (22*b*) provided on the side surface of the frame 29 to be smaller on the open surface 35 side and larger on the opposite side, the length of the support piece 22*a* (22*b*) may be set to be longer on the open surface 35 side and shorter on the opposite side, and only the portions which are closer to both edges of the frame bodies 21*a*, 21*b* may be fixed thereto by spot welding, as shown in the side elevational view of the main part of the frame in FIG. 18. Alternatively, the center of the edge of the support piece 22*a* (22*b*) on the open surface 35 side may be notched in the shape of V, as shown in FIG. 19.

Figure 20:
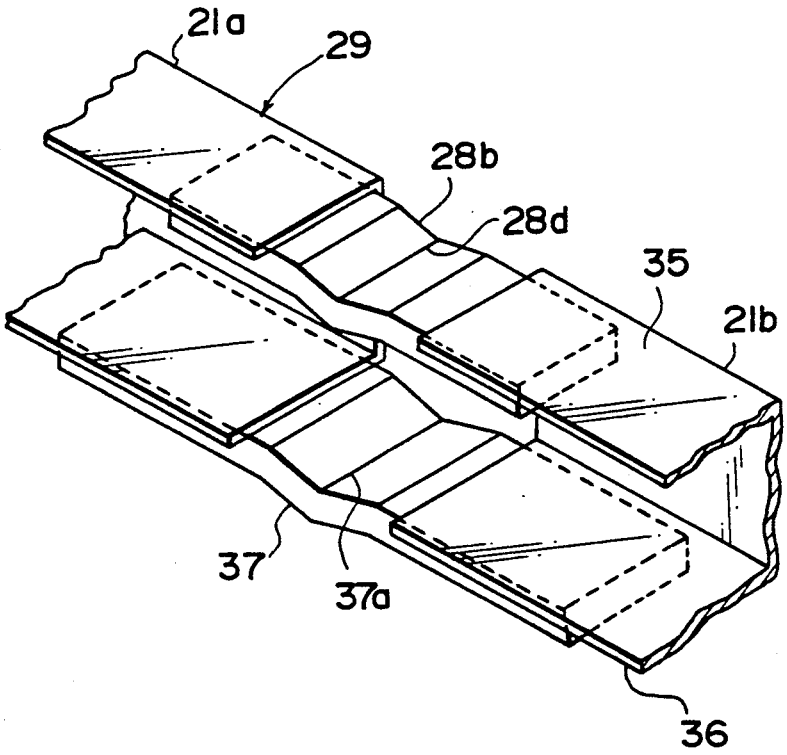
FIG. 20 is a side elevational view of a further example of a support piece for connecting the frame bodies of the second embodiment.

Similar operation and advantages to those of the second embodiment are also obtained by providing a support piece 37 having a larger size and a stronger elastic force at a bent portion 37*a* than the support piece 28*a* (28*b*) on the other open surface 39 side of the frame 29 in parallel with the support piece 28*a* (28*b*) instead of the support piece 22*a* (22*b*), as shown in the perspective view of the main part of the frame in FIG. 20 (only a single short side of the frame 29 is shown).

Figure 21:
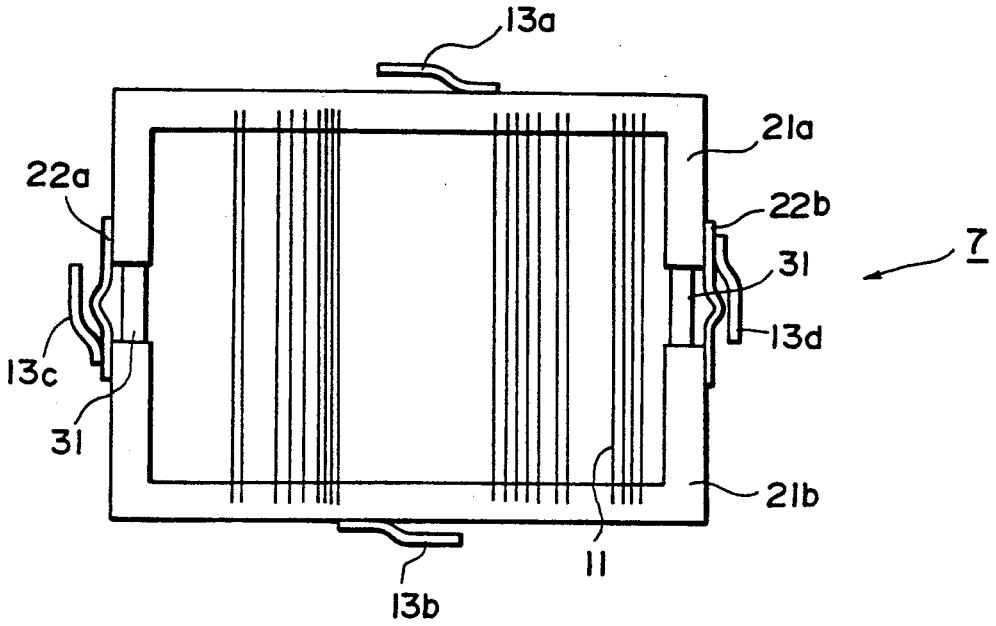
FIG. 21 is a plan view of an example of a color selection electrode device provided with holding members for attaching the color selection electrode device to a panel glass.
Figure 22:
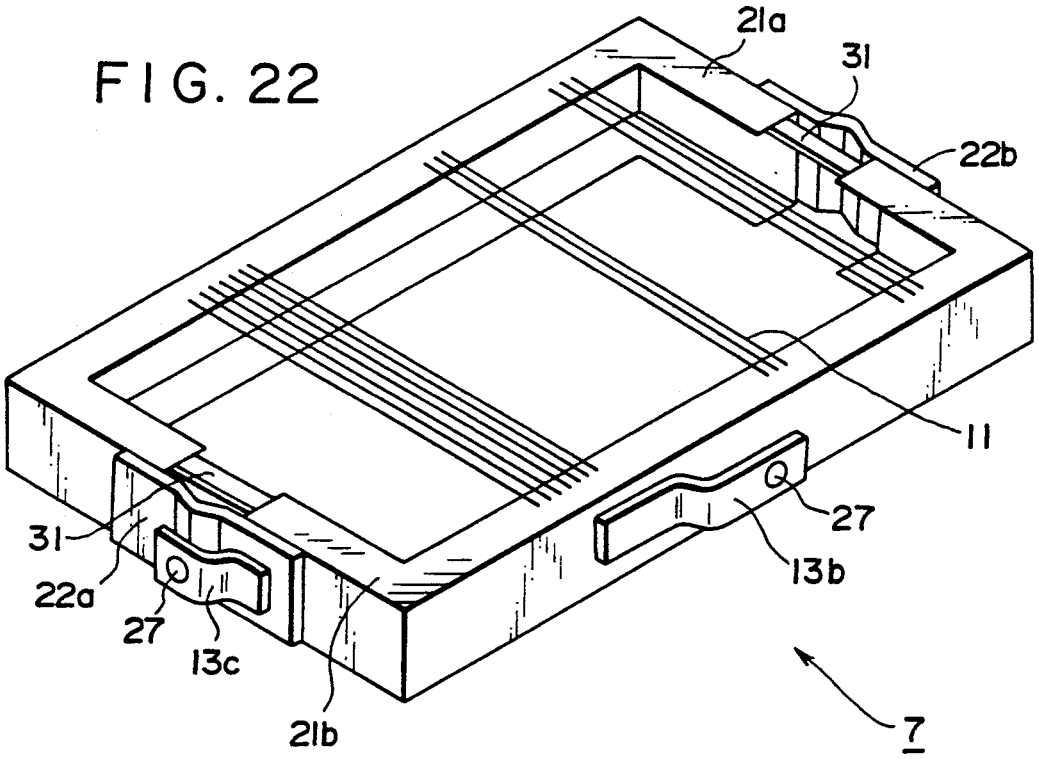
FIG. 22 is a perspective view of the color selection electrode device shown in FIG. 21.
Figure 23:
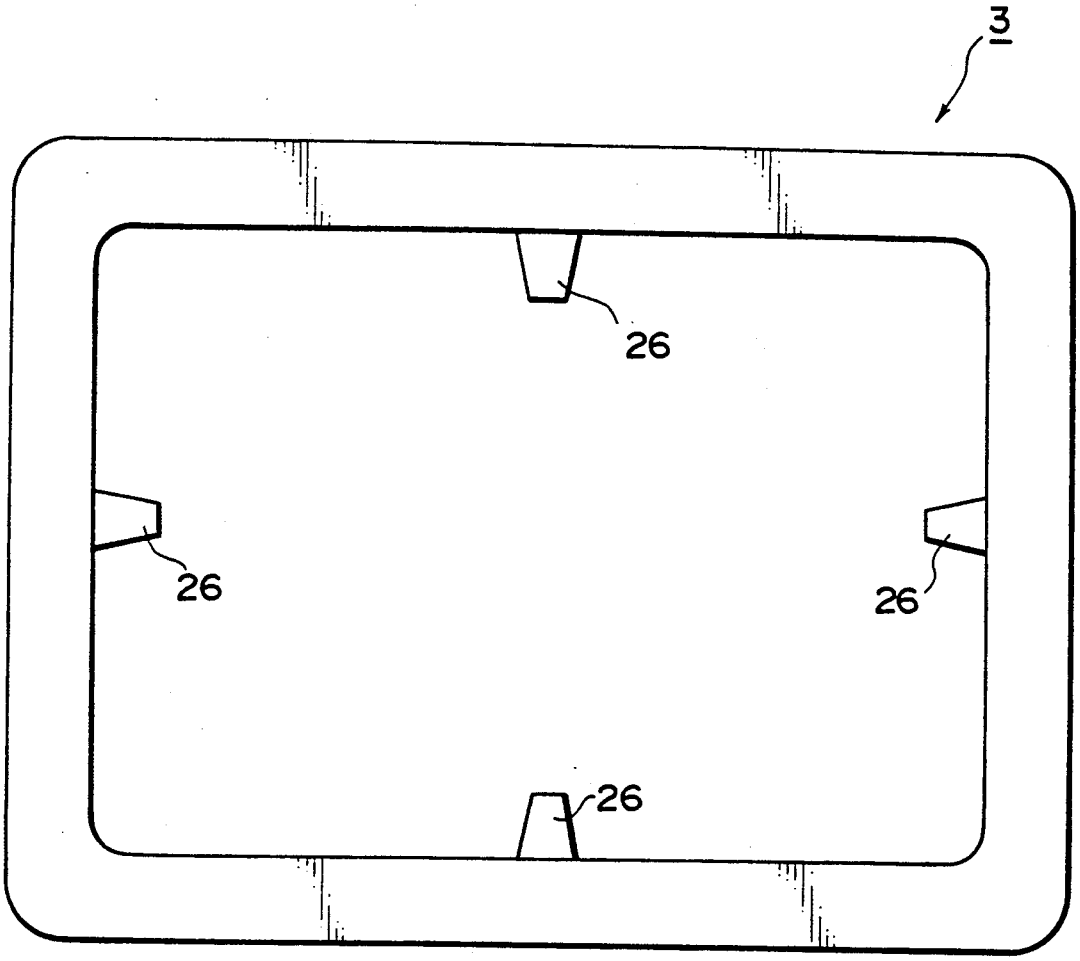
FIG. 23 is an elevational view of an example of a panel glass to which the color selection electrode device shown in FIG. 21 is attached.

A method of holding a color selection electrode device will now be explained. In a color selection electrode device shown in the plan view in FIG. 21 and the perspective view in FIG. 22, holding members 13*c*, 13*d* are provided at the central portions of the frame bodies 21*a*, 21*b* and holding members 13*c*, 13*d* are provided on the support pieces 22*a*, 22*b*. Each of the holding members 13 is made of a spring material and is provided with a through hole 27. The through holes 27 are engaged with support pins 26 provided at the corresponding positions within the panel glass (panel portion) 3 shown in FIG. 23.

The color selection electrode device 7 is held within the panel glass 3 at three or four points by engaging the holding members 13*a* to 13*d* which are provided in the vicinity of the central portions of the pair of frame bodies 21*a*, 21*b* and support pieces 22*a*, 22*b* with the support pins 26 provided in the vicinity of the centers of inner surfaces of the longer sides and the shorter sides of the panel glass 3.

Figure 24:
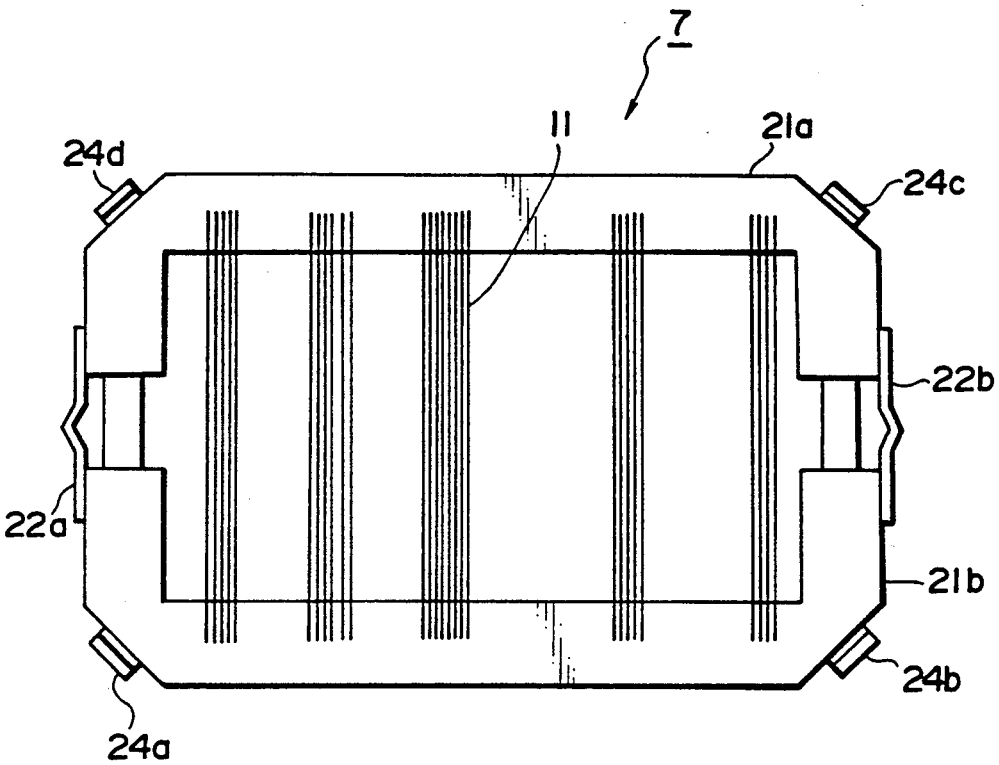
FIG. 24 is a plan view of another example of a color selection electrode device provided with holding members for attaching the color selection electrode device to a panel glass.
Figure 25:
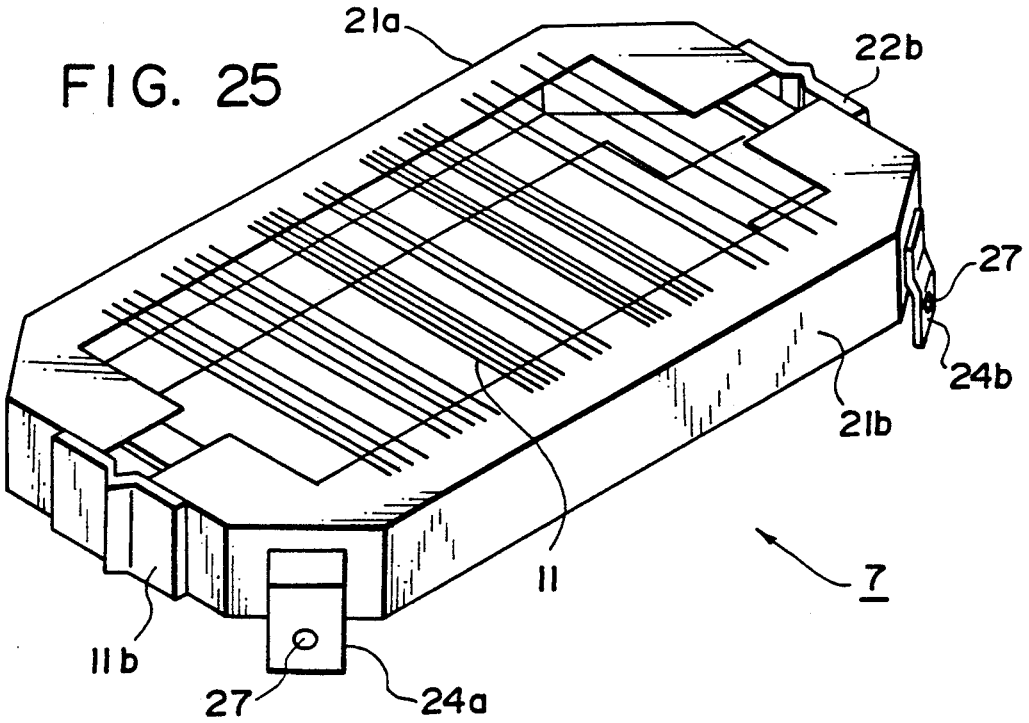
FIG. 25 is a perspective view of the color selection electrode device shown in FIG. 24.

The color selection electrode device may be held by the following method. In a color selection electrode device shown in the plan view in FIG. 24 and the perspective view in FIG. 25, the opposing frame bodies 21*a*, 21*b* have flat corner portions which facilitate the attachment of holding members 24*a* to 24*d*. Each holding member 24 having a function as a spring is attached to the corresponding corner portion by welding or the like and is provided with a through hole 27 which is engaged with the corresponding support pin 26 provided on the inside of the panel glass 3 shown in FIG. 26.

Figure 26:
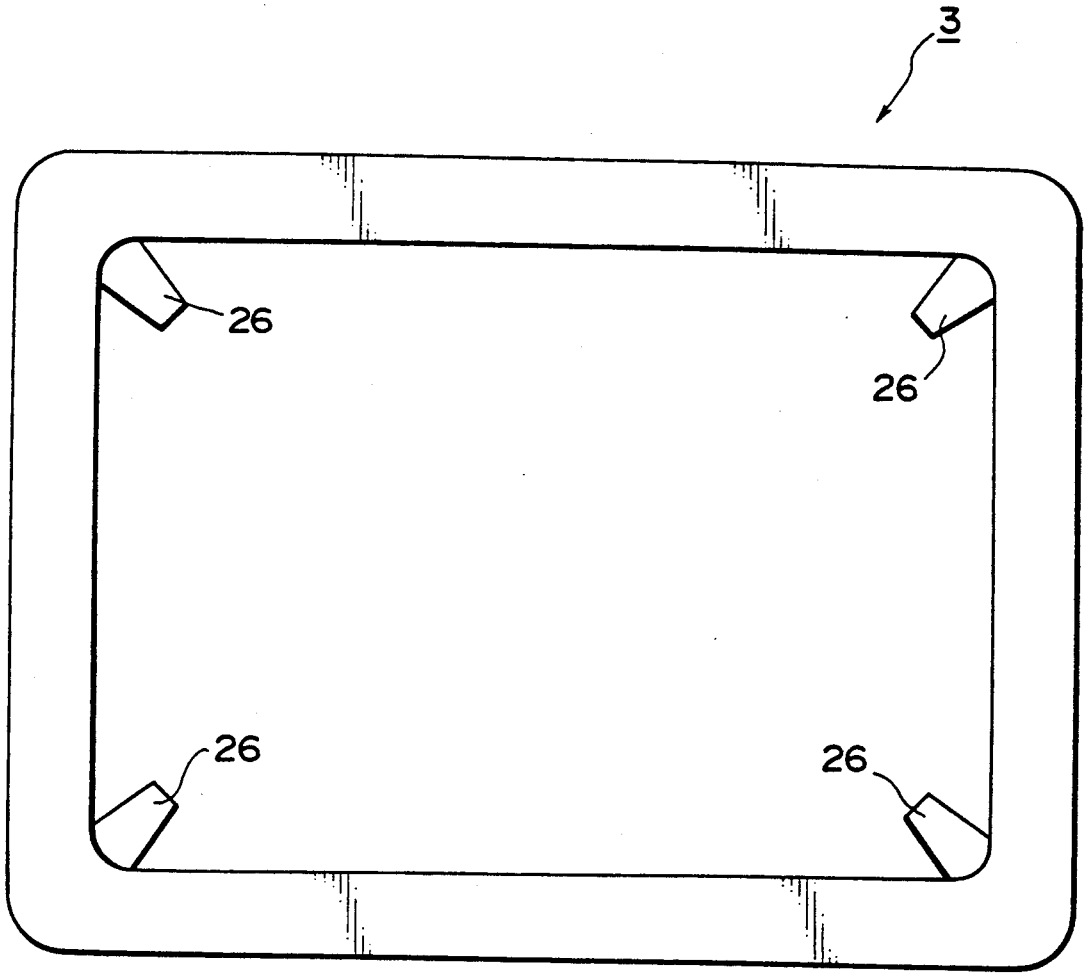
FIG. 26 is an elevational view of an example of a panel glass to which the color selection electrode device shown in FIG. 24 is attached.

FIG. 26 is a plan view of the panel glass 3 of the vessel, as viewed from the inside thereof. As shown in FIG. 26, the support pin 26 such as a stud pin is embedded to each corner of the panel glass 3.

The color selection electrode device is held within the panel glass 3 at four points by engaging the support pins 26 at the corner portions of the panel glass 3 with the through holes 27 of the holding members 24*a* to 24*d* of the color selection electrode device 7. By this method, since undesired warping caused by the thermal strain or the accumulation of the minute displacement of each spring material at the time of manufacturing the color selection electrode device 7 is corrected, as compared with the holding method shown in FIGS. 21 to 23. It is therefore easy to set the color selection electrode 11 and the phosphor screen 6 (FIG. 30) at a predetermined relative position. In the process of forming the phosphor screen 6 on the inner surface of the face plate 5, the reproducibility of the relative position of the color selection electrode 11 and the phosphor screen 6 a part of which has already been formed on the inner surface of the face plate 6 is enhanced, thereby producing a high-definition picture.

Figure 27:
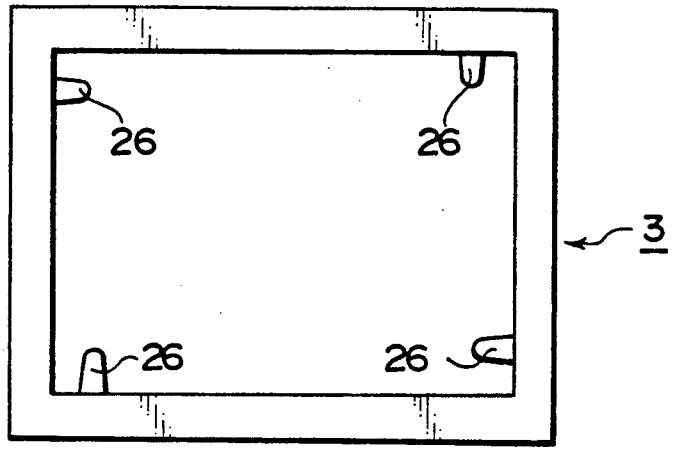
FIG. 27 is an elevational view of a modification of the panel glass to which the color selection electrode device shown in FIG. 24 is attached.
Figure 28:
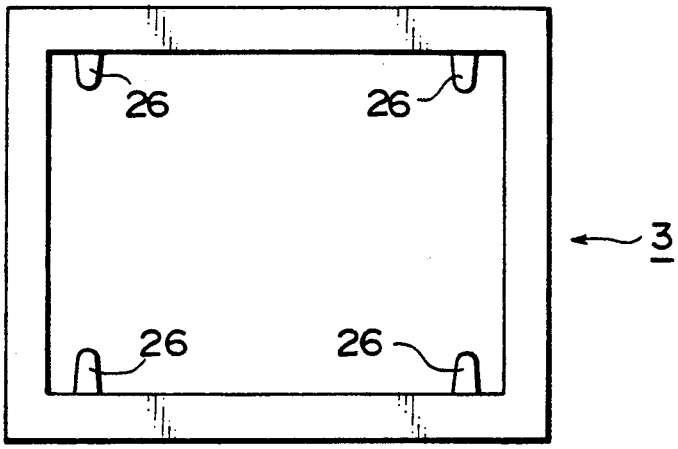
FIG. 28 is an elevational view of another modification of the panel glass to which the color selection electrode device shown in FIG. 24 is attached.
Figure 29:
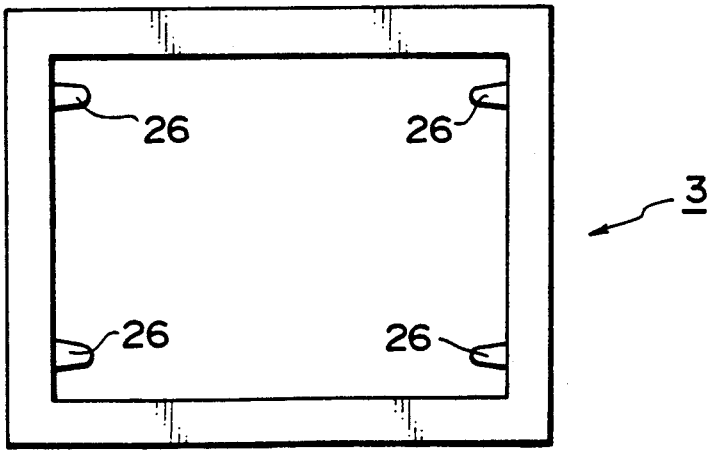
FIG. 29 is an elevational view of still another modification of the panel glass to which the color selection electrode device shown in FIG. 24 is attached.
Figure 32:
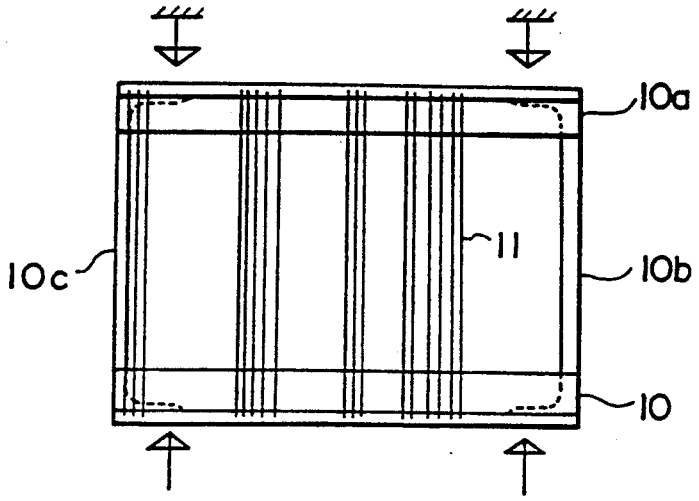
FIG. 32 PRIOR ART
FIG. 32 is an explanatory view of a method of manufacturing the conventional color selection electrode device shown in FIG. 31.
Figure 33:
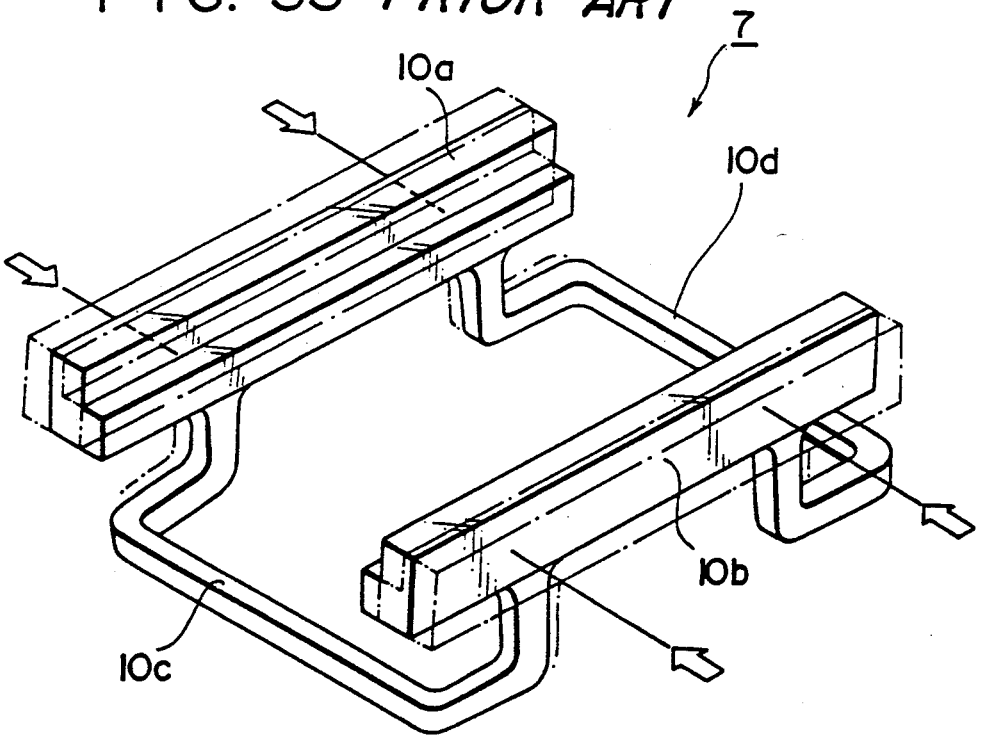
FIG. 33 PRIOR ART
FIG. 33 shows the longitudinal frame members of the conventional color selection electrode device shown in FIG. 31 before and after a load is applied thereto.

Although the color selection electrode device 7 is held within the panel glass 3 by the support pins 26 arranged at the corners toward the inner part of the panel in the above described holding method, as shown in FIG. 26, the support pins 26 may also be arranged as shown in FIGS. 27 to 29. That is, similar effects are obtained by arranging the support pins 26 toward the inner part of the panel in the vicinity of the corner portions at the positions which enable the two-point support of each side of the frame of the color selection electrode and by arranging the holding members 24*a* to 24*d* at the corresponding positions of the color selection electrode device.

In this case, it is preferable to hold the color selection electrode device in the vicinity of the corner portions of the longer sides of the frame, because the undesirable warping of the color selection electrode device is corrected to a greater extent and the reproducibility of the color selection electrode and the phosphor screen is more excellent than in the case of holding the color selection electrode device in the vicinity of the corner portions of the shorter sides of the frame.

A seat may be provided between each of the holding members 24*a* to 24*d* and the position to which each of the holding members 24*a* to 24*d* is attached. The seat can improve the positional accuracy for attaching the color selection electrode device to the panel glass 3.

The color selection electrode device is held within the panel glass by the engagement between the holding members and the support pins in the above-described examples, but the holding mechanism is not restricted thereto.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A color selection electrode device for a cathode ray tube comprising:

(A) a color selection electrode composed of filaments for regulating the position which an electron beam of the cathode ray tube reaches;

(B) a pair of U-shaped frame bodies between which the color selection electrode is stretched; and (C) support pieces for connecting both end portions of the pair of frame bodies and holding the frame bodies at a predetermined space, the support pieces having an elastic restoring force which applies a predetermined tension to the color selection electrode stretched between the pair of frame bodies.

2. A cathode ray tube comprising:

a glass panel; and a color selection electrode device, according to claim 1 which is disposed on the inside of the glass panel in such a manner as to face the glass panel surface;

the color selection electrode device being mounted on the inside of the glass panel while being held at the corner portions of the inside of the glass panel or at a plurality of points in the vicinity thereof.

3. A color selection electrode device according to claim 1, wherein the color selection electrode is stretched between the pair of frame bodies while a distributed load is applied to the pair of frame bodies so that the displacement amount of the distance between the opposing pair of the frame bodies at the central portion is larger than that of the distance between the frame bodies at either end portion.

4. A color selection electrode device according to claim 1, wherein the color selection electrode and each of the frame bodies are composed of stainless steel so as to omit a blackening heat-treatment process for preventing the color selection electrode device from rusting.

5. A color selection electrode device according to claim 1, wherein each of the frame bodies is composed of an elastic material so that the elastic restoring force of the frame bodies themselves in addition to the elastic force of the support pieces apply a predetermined tension to the color selection electrode.

6. A color selection electrode device according to claim 1, wherein a frame composed of the pair of frame bodies and the support pieces for connecting the frame bodies is bent at the central portions of the connecting portions by a minute amount outwardly from the open surface for receiving the stretched color selection electrode when a load is applied to the frame bodies at the time of stretching the color selection electrode.

7. The color selection electrode device of claim 1 wherein each of said U-shaped frame bodies has a channel shaped cross section.

8. The color selection electrode device of claim 1 wherein each of said support pieces is a compressionally resilient spring.

9. The color selection electrode device of claim 8 wherein said U-shaped frame bodies are constrained to form a substantially planar color electrode supporting frame.

10. The color selection electrode device of claim 9 wherein said compressionally resilient spring is at least one substantially planar spring element with a V-shaped bend provided therein to provide compressional force without any substantial folding moment.

11. The color selection electrode of claim 10 wherein first and second planar spring elements are provided for joining the end portions of each U-shaped frame body by their respective front faces and side edges.

12. The color selection electrode device of claim 10 further comprising metal plates welded between said U-shaped frame bodies to inhibit warping of the color electrode supporting frame.

13. The color selection electrode device of claim 8 wherein said spring is formed of an anticorrosive material.

14. The color selection electrode device of claim 1 wherein said U-shaped frame bodies are formed of an anticorrosive material thereby avoiding any need for a blackening heat treating process which might lower tension in the color selection electrode and thus increasing resistance of the color selection electrode to vibration.

15. The color selection device of claim 14 wherein said anticorrosive material is stainless steel.

* * * * *